US005095868A

United States Patent [19]

Brighigna

[11] Patent Number: 5,095,868

[45] Date of Patent: Mar. 17, 1992

[54] CLAMPING DEVICE FOR THE CYLINDER HEADS OF AERO ENGINES

[75] Inventor: Mario Brighigna, Cento, Italy

[73] Assignee: VM Motori S.P.A., Ferrara, Italy

[21] Appl. No.: 572,129

[22] Filed: Aug. 23, 1990

[30] Foreign Application Priority Data

Mar. 23, 1990 [IT] Italy ..... 3408 A/90

[51] Int. Cl.[5] ..... F02F 1/00

[52] U.S. Cl. ..... 123/193.3; 123/193.2; 123/193.5

[58] Field of Search ..... 123/193 C, 193 H, 193 CH, 123/41.82

[56] References Cited

U.S. PATENT DOCUMENTS 1,341,227 5/1920 Diamond ..... 123/193 CH
2,736,300 2/1956 Flynn ..... 123/193 CH
3,659,568 5/1972 Howe ..... 123/193 CH
4,494,491 1/1985 Takada et al. ..... 123/193 CH

*Primary Examiner*—Andrew M. Dolinar
*Assistant Examiner*—M. Macy
*Attorney, Agent, or Firm*—Fay, Sharpe, Beall, Fagan, Minnich & McKee

[57] ABSTRACT

The conventional screw coupling between cylinder head and liner is reinforced externally by the addition of a number of bolts arranged around the circumference of the head and extending parallel with the longitudinal axis of the head through a distance whereby at least the threads of the screw coupling are entirely compassed; each bolt is accommodated by a relative socket incorporated into the head casting, secured with a relative nut and torqued in such a way as to tension the section of the head surrounding the coupling.

9 Claims, 2 Drawing Sheets

23
22
6
5
13
17
9a
14
17
14
2f
9
9
4
8
3
5a
24
9
16
2a
10
11
16
10
15
12
15
X
25
2
21
F
1

CLAMPING DEVICE FOR THE CYLINDER HEADS OF AERO ENGINES

BACKGROUND OF THE INVENTION

The present invention relates to a clamping device for the cylinder heads of aero engines.

In most of the Otto cycle engines fitted to light aircraft (e.g. small executive or tourist planes) and utilizing aviation type gasoline, use is made of a screw fit to couple single head assemblies, each comprising the fuel supply system for one piston, to a crankcase accommodating the connecting rods, crankshaft and compression system; each head affords an internal screw thread, and fits over a corresponding external thread cut onto a liner associated with the crankcase and constituting the relative cylinder in part.

Such an arrangement is intended principally to facilitate and expedite the frequent servicing operations carried out on each head or piston, in any location, when the plane is on the ground between flights.

Given the increasing difficulty in finding fuel for gasoline aero engines, the applicant has already envisaged and proceeded to embody an engine capable of responding to all the usual requirements of a propulsion unit of the type in question, while possessing all or practically all the features of a Diesel engine, first among which being the ability to run on the 'Jet-Al' fuel in widespread use for modern passenger airliners.

In this new aero engine architecture, however, the piston-and-cylinder assembly (which incorporates the combustion chamber) is capable of considerably higher compression ratios than those of former aero engines, not least by reason of the fuel injection and compression ignition operating characteristics. With higher compression generated in the piston and cylinder assembly, and the larger bores typical of the design, significant problems are created with the plain screw fit mentioned above; in particular, the screw coupling may be forced, or at all events loosened by the stress generated during operation, thereby affecting the tightness of the combustion chamber and reducing the efficiency of the engine at altitude, which is clearly unacceptable in an aircraft propulsion unit.

Accordingly, the object of the present invention is to overcome the drawbacks in question by providing a clamping device for the cylinder head and liner assembly of an aero engine that will combine with the screw coupling conventionally adopted to ensure a faultless seal and a better distribution of the forces generated during the compression stroke, without negatively affecting the architecture of the head.

SUMMARY OF THE INVENTION

The stated object is realized, according to the present invention, by clamping each head over the relative liner utilizing an arrangement comprising a plurality of stabilizer rods distributed around the circumference of the head and accommodated in corresponding sockets located externally of the usual screw coupling between head and liner. The rods extend parallel with the longitudinal axis of the head through a distance compassing at least the area occupied by the screw coupling, and each is secured to the head by a corresponding fastener; this also permits of pre-tensioning the part of the head surrounding the screw coupling to a prescribed degree of compression.

Among the advantages afforded by the invention is the fact that the stabilizer rods, being uniformly distributed around the circumference of the head, ensure that the head is secured to the liner fully and stably during maximum fuel-air compression and that the resulting forces are discharged to better effect, being absorbed in part by the clamped head in its pre-tensioned state; similarly, the presence of the rods in some measure lightens the work load on the screw coupling, as regards the function of providing a mechanical seal.

BRIEF DESCRIPTION OF THE DRAWINGS

The invention will now be described in detail, by way of example, with the aid of the accompanying drawings, in which.

DESCRIPTION of the PREFERRED EMBODIMENTS

Figure 1:
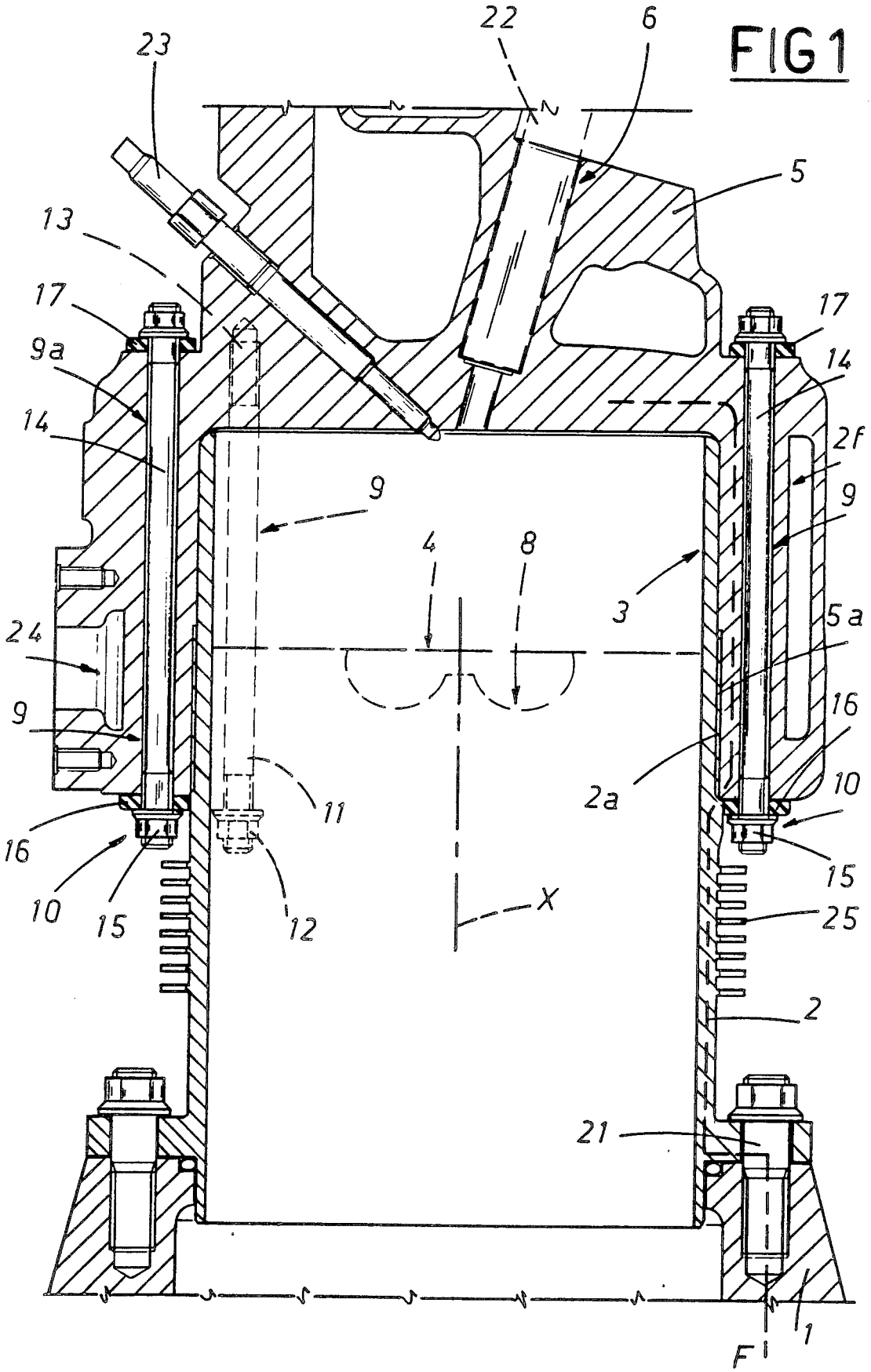
FIG. 1 is the cross section through one cylinder head-and-liner assembly of an aero engine fitted with the device according to the invention.

With reference to the drawings, the clamping device disclosed is suitable for incorporation into Diesel aero engines typically comprising a crankcase 1, and a plurality of cylinder liners 2, generally in steel, secured to the crankcase by bolts 21 (see FIG. 1). Each liner 2 encompasses a corresponding cylinder 3 accommodating the respective piston 4 (phantom line FIG. 1); in addition, the outermost circumferential surface of the liner 2 affords an external screw thread **2*a* located adjacent to a set of cooling fins 25 and designed to pair with a corresponding internal thread 5*a* afforded by the bottom of the relative head 5. The screw coupling thus created serves to fasten the head stably to the liner 2**.

Each of the heads 5, which are cast in light alloy (e.g. aluminum), comprises a fuel injection system denoted 6 consisting in an injector 22 and a glow plug 23 occupying substantially central positions in the head, and an exhaust duct 7 carrying away post-combustion gases. The inner central area of the head 5 constitutes one part of a combustion chamber 8, directed toward and coaxial with the crown of the relative piston 4, internally of which the injected fuel is compressed and ultimately burned; the crown of the piston itself provides the remaining part of the chamber 8. Each head 5 also affords a circumferential gallery 24 through which coolant is directed.

Figure 3:
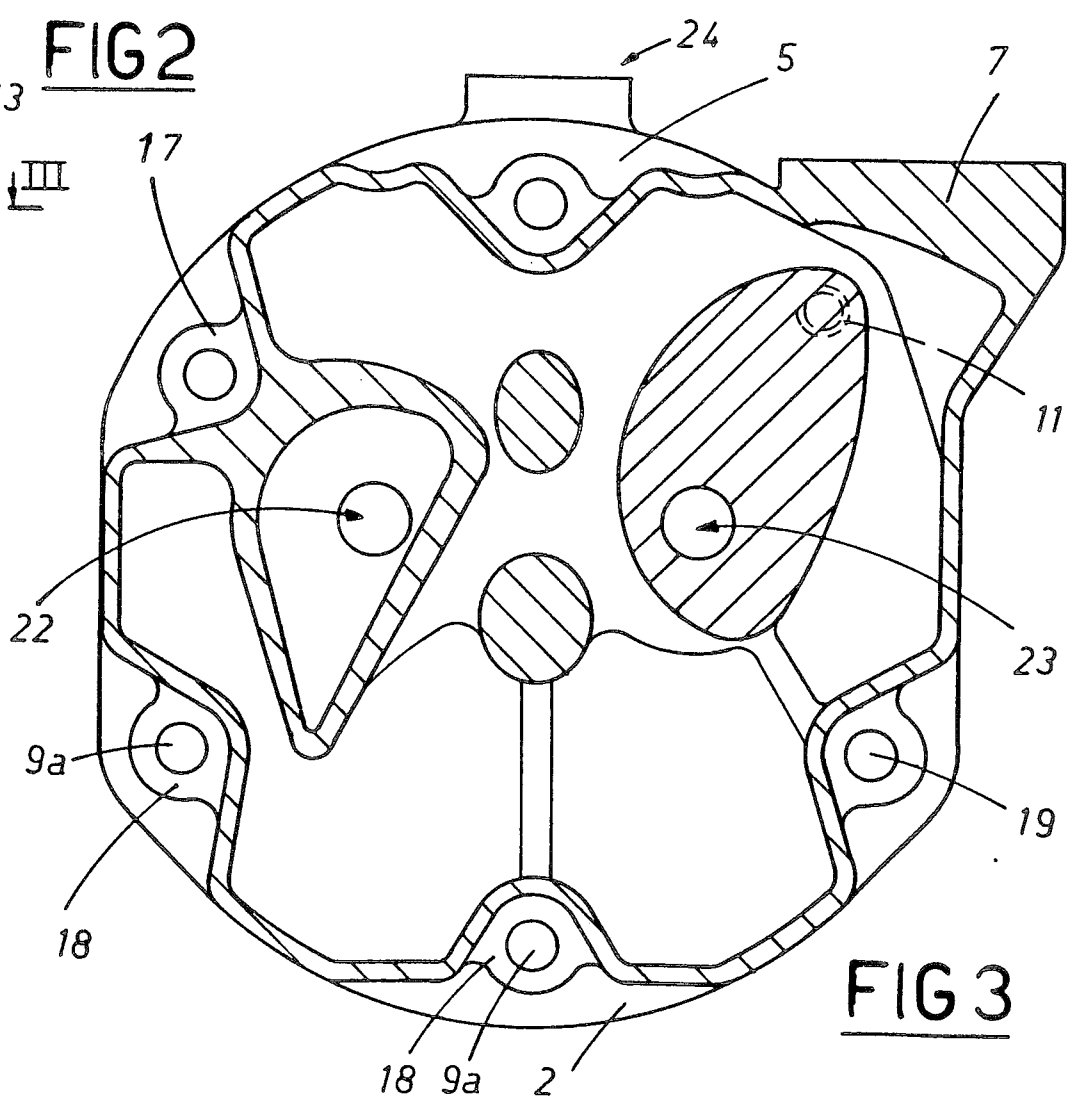
FIG. 3 is a cross section of the head-and-liner assembly of FIG. 2 along line 3—3, and with certain parts omitted.

According to the invention, each head 5 exhibits a plurality of circumferentially arranged stabilizer rods 9 occupying corresponding sockets **9*a* (FIG. 3). The rods 9 are located externally of the screw coupling between head 5 and liner 2 and disposed, more exactly, between the screw threads 2*a*–5*a* and the coolant gallery 24 (FIGS. 1 and 2), extending parallel with the longitudinal axis x of the head 5 through a distance such as compasses the entire area occupied by the threads and the part of the head 5 surrounding the combustion chamber 8. 10 denotes a fastener associated with each of the stabilizer rods 9**, by which the rod can be rigidly secured at least to the head, and also tightened advantageously to pre-load that part of the head casting which surrounds the screw coupling with a given degree of compressive tension.

As discernible from FIG. 3, the rods 9 (of which there are six per head in the example illustrated) are accommodated in corresponding sockets 9*a* that consist in through holes afforded by the casting. By contrast, one rod positioned in the area of the exhaust duct 7 is accommodated in a blind hole 13 (phantom line, FIGS. 1 and 2), affording a thread at its stopped end; this particular rod, whether in the embodiment of FIG. 1 or that of FIG. 2, consists simply in a stud 11 secured at the end nearest the base of the liner 2 by a first nut 12, and screwed into the stopped hole 13 at the opposite end. The regular stabilizer rods, denoted 9 in FIG. 1, each consist in a bolt 14 accommodated internally of the relative socket 9*a*, of which the threaded end is directed toward the base of the liner 2 and engaged by a respective lock nut 15 that provides the fastener 10 aforementioned. 16 denotes flexible means located between the head of the bolt 14 and the cylinder head 5 and between the head 5 and the lock nut 15.

In the embodiment of FIG. 1, flexible means located between the head of the bolt and the cylinder head consist in a lock washer 17.

Figure 2:
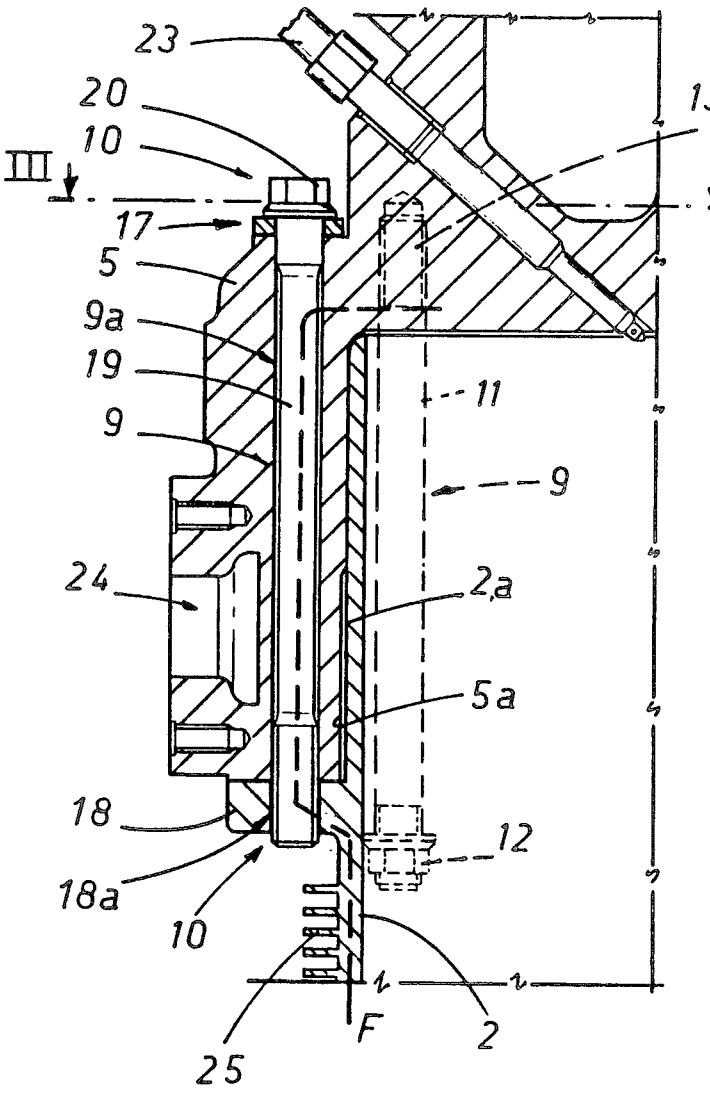
FIG. 2 is the cross section of part of a cylinder head-and-liner assembly dissimilar to that of FIG. 1 and incorporating an alternative embodiment of the clamping device according to the invention.

In the example of FIG. 2, the liner 2 exhibits a circumferential ring or shoulder 18 encircling the part between the thread 2*a* and the cooling fins 25 and affording an abutment for the head 5. In this embodiment, each rod 9 consists in a second stud 19 secured at one end by a second nut 20 and engaging at the remaining end with a corresponding threaded socket 18*a* afforded by the abutment ring 18 in a position of coaxial alignment with the socket 9*a* provided in the head 5 to accommodate the stud 19; flexible means 16 are located between the second nut 20 and the head 5.

Each head 5 is screwed first onto the corresponding liner 2, whereupon the rods 9 are inserted into the relative sockets and clamped in such a way that the head is compression-preloaded, as aforementioned, to achieve improved distribution and cushioning of the forces generated during combustion of the fuel. The forces in question (considerable in this type of engine) are directed prevalently toward the top of the cylinder, but with the head 5 pre-tensioned by the rods, will tend to be distributed over the entire circumference of the liner 2 and discharge along its length as indicated by the arrows F of FIGS. 1 and 2; accordingly, the head 5 will not be affected unduly by high compression forces even with particularly large bores, a conventional basic aero engine architecture can be retained, and the ease with which the single heads are removed for servicing purposes remains unaffected. In addition, stud screws will ensure that the head remains securely clamped in the face of possible loosening forces, for instance vibration, that might diminish the efficiency of the engine when operating at altitude.

What is claimed:

1. A clamping device for the heads of aero engines comprising:

a crankcase;

a plurality of liners associated with the crank case, each encompassing a corresponding cylinder and a respective piston, and each having a screw thread disposed about its external circumference;

a plurality of cylinder heads, each having an internal screw thread matched to and coupled with the external thread of a corresponding liner so as to form a screw coupling, and constituting one part of a combustion chamber directed coaxially toward the corresponding piston, wherein a crown of each cylinder head affords the remaining part of the chamber;

a plurality of stabilizer rods arranged circumferentially around each cylinder head and accommodated in respective sockets encompassing the screw coupling, which extend substantially parallel with the longitudinal axis of the head through a distance encircling at least the area occupied by the screw coupling and extending at least the whole combustion chamber height;

a plurality of fasteners, by which the stabilizer rods are secured respectively at least to the head and tensioned in such a way that the part of the head immediately surrounding the screw coupling is compression preloaded.

2. A device as in claim 1, wherein at least one of the stabilizer rods comprises a stud screw secured at the end nearest the base of the liner by a lock nut and screwed at the opposite end into a blind threaded hole sited near an exhaust duct.

3. A device as in claim 1, wherein each stabilizer rod comprises a bolt insertable into a through hole afforded by the head and secured at the threaded end located nearest the base of the liner by a corresponding lock nut, providing the fastener, together with flexible means located between the head of the bolt and the cylinder head and between the cylinder head and the lock nut.

4. A device as in claim 1, wherein the liner comprises a circumferential ring or shoulder located adjacent the external screw thread and providing an abutment for the head, and each stabilizer rod comprises a second stud screw secured at one end by a second lock nut in conjunction with a flexible means located between the second lock nut and the cylinder head, and screwed by its remaining end into a respective threaded socket afforded by the abutment ring in a position coaxial with the socket provided in the head to accommodate the stud screw.

5. A clamping device for the heads of internal combustion engines, comprising:

a crankcase;

a liner associated with the crankcase, said liner encircling a corresponding cylinder and a piston, said liner including a screw thread disposed about the liner's external circumference;

a cylinder head having an internal screw thread which mates with said liner screw thread to form a screw coupling, said cylinder head comprising one part of a combustion chamber directed coaxially with said piston, wherein a crown of said cylinder head provides a remaining part of said combustion chamber; and, a means for compression preloading said cylinder head directly adjacent said crew coupling wherein said means for compression preloading comprises:

a plurality of stabilizer rods arranged circumferentially around said cylinder head and accomodated in respective sockets in said cylinder head, said sockets encircling said screw coupling, said plurality of stabilizer rods extending substantially parallel to a longitudinal axis of said cylinder head through a distance encircling at least an area occupied by said screw coupling and extending at least a height of said combustion chamber: and, fastener means for securing said stabilizer rods to said cylinder head and tensioning said stabilizer rods.

6. The device of claim 5 wherein said stabilizer rods each comprise a stud screw secured to said liner by a lock nut.

7. The device of claim 5 wherein each stabilizer rod comprises a bolt insertable in a through aperture of said cylinder head, said bolt comprising a head and a threaded shank and wherein said fastener means comprises:

a lock nut engageable with said bolt threaded shank; and, a flexible washer located between said bolt head and said cylinder head.

8. The device of claim 7 wherein said fastener means further comprises a second flexible washer located between said lock nut and said cylinder head.

9. The device of claim 5 wherein said liner comprises a circumferential shoulder located adjacent said external screw thread and wherein each stabilizer rod comprises a stud screw and wherein said fastener means comprises;

a locknut engageable with said stud screw; and, a flexible washer located between said luck nut and said cylinder head, wherein a remaining end of said stud screw is fastened in a respective socket provided in said circumferential shoulder.

* * * * *